US005462802A

United States Patent [19]

Mikoshiba et al.

[11] Patent Number: 5,462,802

[45] Date of Patent: Oct. 31, 1995

[54] POLYAMIDE HOLLOW AND/OR NON-CIRCULAR FIBER AND PROCESS FOR MAKING SAME

[75] Inventors: Yoshihisa Mikoshiba; Teruhiko Adachi; Kouji Tajiri, all of Mihara, Japan

[73] Assignee: Teijin Limited, Osaka, Japan

[21] Appl. No.: 243,494

[22] Filed: May 16, 1994

Related U.S. Application Data

[63] Continuation-in-part of Ser. No. 982,643, Dec. 1, 1992, abandoned.

[30] Foreign Application Priority Data

Dec. 2, 1991 [JP] Japan ..... 3-341840

[51] Int. Cl.[6] ..... D02G 3/00

[52] U.S. Cl. ..... 428/376; 428/397; 428/398

[58] Field of Search ..... 428/364, 376, 428/395, 397, 398; 528/323

[56] References Cited

U.S. PATENT DOCUMENTS

| | | | |
|---|---|---|---|
| 3,095,258 | 6/1963 | Scott . | |
| 3,386,967 | 6/1968 | Twilley | 528/323 |
| 3,508,390 | 4/1970 | Bagnall et al. . | |
| 3,755,221 | 8/1973 | Hitch . | |
| 3,839,530 | 10/1974 | Bingham et al. . | |
| 3,852,401 | 12/1974 | Suzuki et al. . | |
| 4,237,034 | 12/1980 | Tomka et al. . | |
| 4,370,431 | 1/1983 | Lienhard et al. . | |
| 4,492,731 | 1/1985 | Bankar et al. | 428/397 |
| 5,202,185 | 4/1993 | Samuelson . | |
| 5,208,107 | 5/1993 | Yeh et al. | 428/397 |
| 5,322,736 | 6/1994 | Boyle et al. | 428/397 |

FOREIGN PATENT DOCUMENTS

| | | |
|---|---|---|
| 48-42134 | 6/1973 | Japan . |
| 48-28975 | 9/1973 | Japan . |
| 54-15023 | 2/1979 | Japan . |
| 62-62911 | 3/1987 | Japan . |
| 63-92717 | 4/1988 | Japan . |

*Primary Examiner*—N. Edwards

*Attorney, Agent, or Firm*—Armstrong, Westerman, Hattori, McLeland & Naughton

[57] ABSTRACT

A polyamide hollow and/or non-circular fiber containing a metal salt of a saturated fatty acid having at least 10 carbon atoms, wherein the amount (X) of a terminal carboxyl group is not larger than 60 gram equivalent per 1,000 kg of the polyamide and the amount (Y) (in parts by weight per 100 parts by weight of the polyamide) of the metal salt of a saturated fatty acid satisfies the following formula:

$$Y \geqq 0.00871X - 0.13$$

wherein X is the amount of the terminal carboxyl group in gram equivalent/1,000 kg of the polyamide.

3 Claims, 2 Drawing Sheets

POLYAMIDE HOLLOW AND/OR NON-CIRCULAR FIBER AND PROCESS FOR MAKING SAME

CROSS-REFERENCE TO RELATED APPLICATION

This application is a continuation-in-part of application Ser. No. 07/982,643 filed on Dec. 1, 1992, now abandoned.

BACKGROUND OF THE INVENTION (1) Field of the Invention

This invention relates to a polyamide hollow and/or non-circular fiber and a process for making the same. More particularly, it relates to a polyamide hollow and/or non-circular fiber having enhanced degree of hollowness and/or degree of non-circularity (modification ratio), and to a process for making the same.

By the term "polyamide hollow and/or non-circular fiber" used herein, we mean a polyamide hollow-core fiber having a circular cross-section or a non-circular cross-section, or a polyamide solid (i.e., non-hollow) fiber having a non-circular cross-section.

(2) Description of the Related Art

Polyamide hollow fibers are generally characterized as exhibiting a lower apparent density, a lower rate of heat transfer, a reduced pilling and unique optical effects such as higher opacity, or sparkle. Polyamide non-circular fibers are generally characterized as exhibiting a lower rate of heat transfer, a higher covering power, a higher bulk and unique optical effects. Therefore, polyamide hollow and/or non-circular fibers are used for construction of floor coverings such as a carpet, and for fabrics having an attractive appearance.

Attempts have heretofore been made to make polyamide fibers having an enhanced non-circularity and/or hollowness. As such attempts, there can be mentioned a method of using a spinneret having a special configuration (Japanese Examined Patent Publication No. 36-20770, Japanese Examined Utility Model Application No. 58-12856, U.S. Pat. No. 3,508,390, and Japanese Unexamined Patent Publication No. 48-42134), and a method of using a polyamide having a high degree of polymerization, i.e., exhibiting a high melt viscosity (Japanese Examined Patent Publication No. H1- 37486). The method of using a spinneret having a special configuration has a problem such that the number of orifices in a spinneret plate is restricted. It is quite difficult to make a non-circular fiber having desired characteristics. In the method of using a polyamide having a high degree of polymerization, the fiber-making becomes difficult with an increase of the melt viscosity, and the degree of non-circularity (modification ratio) and the degree of hollowness are restricted.

Proposals of incorporating a metal salt of a fatty acid in a polyamide have heretofore been made, but there is no technical idea of making polyamide fibers having an enhanced degree of non-circularity (modification ratio) and/or degree of hollowness in these proposals. For example, Japanese Examined Patent Publication No. 48-28975 teaches that a magnesium salt of a carboxylic acid has a function of minimizing the deposit of a polyamide on a spinneret and preventing the yarn breakage when melt spun. Japanese Unexamined Patent Publication No. 62-62911 teaches that yarn breakage at a high speed melt-spinning is prevented by adding a magnesium compound including a magnesium salt of a higher fatty acid. Japanese Unexamined Patent Publication No. 63-92717 teaches that incorporation of an isoindolinone pigment and a metal salt of stearic acid in a polyamide prevents the undesirable reaction between the isoindolinone pigment and the polyamide.

SUMMARY OF THE INVENTION

An object of the present invention is to provide a polyamide hollow and/or non-circular fiber having an enhanced degree of hollowness and/or an enhanced degree of non-circularity (modification ratio) without the use of a spinneret having a special configuration and a polyamide having an especially high degree of polymerization.

In one aspect of the present invention, there is provided a polyamide hollow and/or non-circular fiber comprising a metal salt of a saturated fatty acid having at least 10 carbon atoms, wherein the amount (X) of a terminal carboxyl group of the polyamide constituting the fiber is not larger than 60 gram equivalent per 1,000 kg of the polyamide and the amount (Y) (in parts by weight per 100 parts by weight of the polyamide) of the metal salt of a saturated fatty acid satisfies the following formula:

$$Y \geqq 0.00871X - 0.13$$

wherein X is the amount of the terminal carboxyl group in gram equivalent/1,000 kg of the polyamide.

In another aspect of the present invention, there is provided a method of making a polyamide hollow and/or non-circular fiber, which comprises the steps of:

incorporating a metal salt of a saturated fatty acid having at least 10 carbon atoms in a polyamide containing not larger than 60 gram equivalent of a terminal carboxyl group per 1,000 kg of the polyamide, the amount (Y) (in parts by weight per 100 parts by weight of the polyamide) of the metal salt of a saturated fatty acid satisfying the following formula:

$$Y \geqq 0.00871X - 0.13$$

wherein X represents the amount of the terminal carboxyl group in gram equivalent/1,000 kg of the polyamide; and melt-spinning the thus-obtained polyamide mixture.

DETAILED DESCRIPTION OF THE PREFERRED EMBODIMENTS

By the term "degree of hollowness", used herein, we mean the numerical value (in %) as calculated by the following equation:

$$\text{Degree of hollowness } (\%)=[1-(G_1/G_2)]\times 100$$

wherein $G_1$ is apparent specific gravity of a hollow fiber and $G_2$ is specific gravity of the solid portion (i.e., non-hollow portion) of the hollow fiber. The larger the calculated numerical value, the larger the degree of hollowness.

Figure 3A:
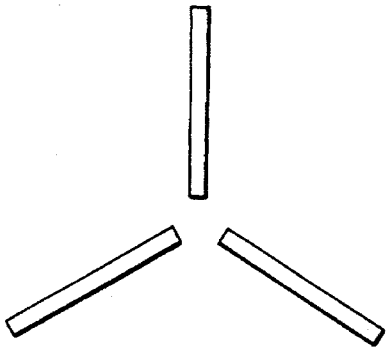
FIG. 3A is an enlarged view of a portion of the face of a spinneret plate, showing one of the spinning orifices, which is used for the production of a solid (i.e., non-hollow) fiber having a non-circular cross-section (more specifically, a trilobal fiber)
Figure 3B:
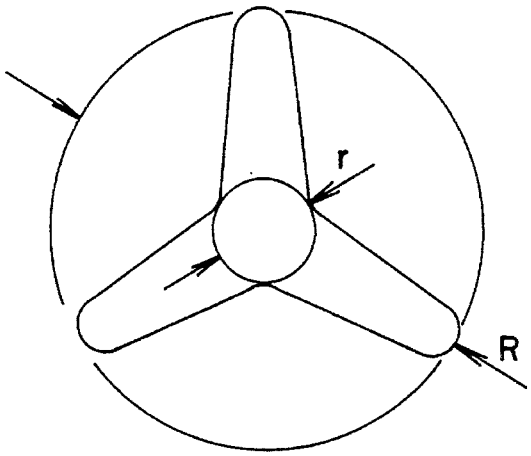
FIG. 3B is an enlarged view of a cross-section of a trilobal fiber obtained by using the spinneret plate of FIG. 3A.

By the term "degree of non-circularity" (modification ratio), used herein, we mean the ratio of the diameter "R" of the circle circumscribed about the fiber cross-section divided by the diameter "r" of the circle inscribed therein (as illustrated in FIG. 3B). The larger the fiber diameter ratio "R/r", the larger the degree of non-circularity (modification ratio).

Figure 2A:
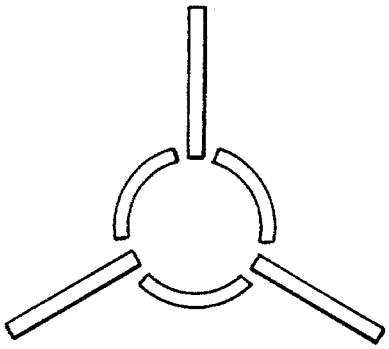
FIG. 2A is an enlarged view of a portion of the face of a spinneret plate, showing one of the spinning orifices, which is used for the production of a hollow non-circular fiber.
Figure 2B:
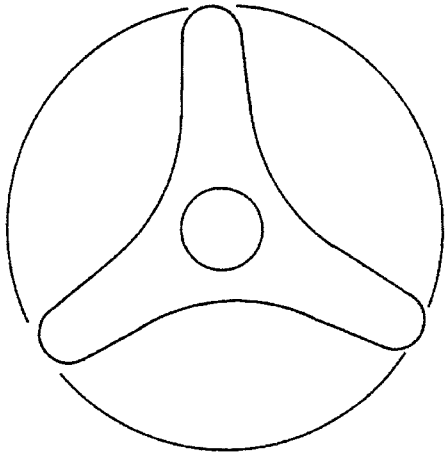
FIG. 2B is an enlarged view of a cross-section of a hollow non-circular fiber obtained by using the spinneret plate of FIG. 2A.

The shape of the cross-section of the non-circular fiber is not particularly limited. The shape of the cross-section is, for example, ribbon, trilobal (FIG. 2B and FIG. 3B) and cruciform. The shape of the cross-section of the hollow fiber may be either circular or non-circular (FIG. 2B).

As the metal salt of a saturated fatty acid having at least 10 carbon atoms used in the invention (which metal salt may be hereinafter abbreviated to "metal salt"), there can be mentioned, for example, an alkali metal or an alkaline earth metal, of a saturated higher fatty acid such as lauric acid, myristic acid, palmitic acid, stearic acid or montanic acid. Of the alkali and alkaline earth metals, sodium, calcium and magnesium are preferable, and magnesium is most preferable.

The method of incorporating the metal salt of a saturated higher fatty acid in a polyamide is not particularly limited, and the incorporation can be carried out, for example, by a dry blending method, a master-chip blending method, a liquid addition method or a polymerization addition method.

The metal salt-incorporated polyamide can be melt spun by a conventional procedure wherein a spinneret plate with orifices for forming the hollow and/or non-circular fiber is used. Namely, the metal salt-incorporated polyamide is melt-extruded into a fiber, the fibrous extrudate is cooled to be thereby solidified, an oiling agent is applied to the fiber, and if desired, the fiber is subjected to drawing, heat-setting and/or entangling treatments, and finally the fiber is taken-up. If desired, additives such as a delustrant such as titanium dioxide, and a light stabilizer, and a pigment and/or dyestuff are incorporated in the polyamide.

The melt-spinning for the non-circular fiber is carried out by using a spinneret plate having orifices of a non-circular shape. For example, a flat fiber having a ribbon-shaped cross-section is obtained by the use of a spinneret plate having straight slots with abrupt terminal expansions or dog bone-shaped slots. A fiber having a trilobal cross-section (FIG. 3B) and a fiber having a cruciform cross-section are obtained by the use of a spinneret plate having Y-shaped slots (FIG. 3A) and a spinneret plate having cruciform slots, respectively, each slot of which may have abrupt terminal expansions. Typical examples of orifices of a spinneret plate used for melt-spinning for the non-circular fiber are described in, for example, U.S. Pat. Nos. 2,939,201, 2,945,739 and 3,508,390.

The melt-spinning for the hollow fiber is carried out by using a spinneret plate having orifices such as, for example, GB P 816,877 and 843,179, and U.S. Pat. No. 3,095,258.

The kind of polyamide used in the present invention is not particularly limited provided that the amount of the terminal carboxyl group satisfies the requirement of the present invention, and as specific examples thereof, there can be mentioned polyamides made from an ω-amino acid or an ω-lactam, such as poly-ε-caproamide, poly-ω-nonamide and poly-ω-lauramide; polyamides made from a dicarboxylic acid and a diamine, such as polyhexamethylene adipamide and polyhexamethylene sebacamide; copolyamides thereof; and polyblends of these polyamides. Polycaproamide is especially preferable because it is melt-spun usually at a temperature of 240° to 260° C. and this temperature region is optimum for melt spinning a mixture thereof with magnesium stearate. At a temperature of 270° C. or higher, magnesium stearate is thermally degraded.

The polyamide hollow and/or non-circular fiber of the present invention is made by melt-spinning a mixture of a polyamide with a metal salt of a saturated fatty acid having at least 10 carbon atoms wherein the amount (X) of a terminal carboxyl group is controlled to not larger than 60 gram equivalent per 1,000 kg of the polyamide and the amount (Y) (parts by weight per 100 parts by weight of the polyamide) of the metal salt of a saturated fatty acid is determined depending upon the amount (X) (gram equivalent/ 1,000 kg of the polyamide) of the metal salt so that the following formula is satisfied.

$$Y \geqq 0.00871X-0.13.$$

The polyamide containing not larger than 60 gram equivalent of a carboxyl group per 1,000 kg of the polyamide can easily be made by using a terminator such as a monoamine.

The above-mentioned control of the two factors, i.e., the amount (X) of a terminal group in the polyamide and the amount of the metal salt, is important, and if one of the two factors is not satisfied, the desired enhancement of the degree of hollowness and/or the degree of non-circularity (modification ratio) of the polyamide fiber cannot be obtained. The importance of the requirements for X and Y, represented by the formula: $Y \geqq 0.00871X-0.13$, will be seen from the following examples.

The invention will now be described by the following examples that by no means limit the scope of the invention.

Experiment 1

The polyamides used in this experiment had the properties shown in Table 1.

TABLE 1

| Polyamide | Degree of polymerization | Amino termial group/ carboxyl terminal group |
|---|---|---|
| A | 1.21 | 10/90 |
| B | 1.10 | 60/60 |
| C | 1.34 | 45/45 |
| D | 1.14 | 70/20 |

The amount of the amino terminal group is determined by dissolving each polyamide in m-cresol and titrating the solution by neutralization with p-toluenesulfonic acid. The amount of the terminal carboxyl group is determined by dissolving each polyamide and titrating the solution by neutralization with an aqueous sodium hydroxide solution. The amount of these terminal groups is expressed in unit of gram equivalent per 1,000 kg of the polymer. The degree of polymerization is expressed in terms of the intrinsic viscosity [η] as measured on a polyamide solution having a concentration of 0.4 g/100 ml in m-cresol at 35 ° C.

To each of the polyamides shown in Table 1, magnesium stearate was added in an amount shown in Table 2 and the mixture was melt spun. More specifically, the mixture was melt-extruded by using an extruder through a spinneret plate having 46 orifices with slots of a 0.12 mm width at a spinning temperature of 250° C., a spinning speed of 900 m/min, a drawing speed of 3,000 m/min and a drawing ratio of 3.25 to obtain a drawn filament yarn composed of 46 filaments and having 830 deniers. The shape of each orifice of the spinneret plate is shown in FIG. 2A.

The degree of hollowness of filaments was determined by measuring the apparent specific gravity ($G_1$) of the hollow filaments and the specific gravity ($G_2$) of the solid portion of filaments similarly made, and calculating the value of $[1-(G_1/G_2)]\times 100$ (%). The results are shown in Table 2. With regard to polyamide type D in Run No. 8 to 13, it was melt-spun at a spinning temperature of 240° C.

TABLE 2

| Run No. | Polyamide | Amount of Mg-St (wt. %) *1 | Deg. of hollowness (%) |
|---|---|---|---|
| 1 | A | — | 16.5 |
| 2 | A | 0.1 | 16.5 |
| 3 | A | 0.2 | 16.5 |
| 4 | A | 0.3 | 16.5 |
| 5 | A | 0.5 | 16.5 |
| 6 | A | 0.7 | 16.6 |
| 7 | A | 1.0 | 17.5 |
| 8 | D | — | 12.0 |
| 9 | D | 0.1 | 12.8 |
| 10 | D | 0.2 | 14.0 |
| 11 | D | 0.3 | 16.2 |
| 12 | D | 0.5 | 19.1 |
| 13 | D | 0.7 | 23.0 |
| 14 | C | — | 17.8 |
| 15 | C | 0.1 | 17.5 |
| 16 | C | 0.2 | 17.8 |
| 17 | C | 0.3 | 18.5 |
| 18 | C | 0.5 | 19.6 |
| 19 | C | 0.7 | 20.5 |
| 20 | B | — | 9.8 |
| 21 | B | 0.1 | 9.8 |
| 22 | B | 0.2 | 9.8 |
| 23 | B | 0.3 | 9.8 |
| 24 | B | 0.5 | 10.5 |
| 25 | B | 1.0 | 12.8 |

*1 Amount of magnesium stearate in % by weight based on the weight of the polyamide As seen from Table 2, the degree of hollowness varies depending upon the kind of the polyamide. Further the following (1), (2) and (3) will be seen from Table 2.

(1) Where the polyamide contains larger than 60 gram equivalent of a carboxyl group per 1,000 kg of the polyamide, the degree of hollowness does not vary irrespective of the amount of the metal salt of a saturated fatty acid.

(2) Where the polyamide contains not larger than 60 gram equivalent of a carboxyl group per 1,000 kg of the polyamide, the degree of hollowness is greatly increased with an increase of the amount of the metal salt of a saturated carboxylic acid. Especially, in the case of polyamide D, when the amount of the metal salt of a carboxylic acid is 0.7% by weight, the degree of hollowness reaches a value about twice as much as that of blank polyamide.

(3) The degree of hollowness varies depending upon the ratio of the terminal amino group to the terminal carboxyl group. A high degree of hollowness is obtained when this ratio is at least 1, preferably at least 3.0.

Figure 1:
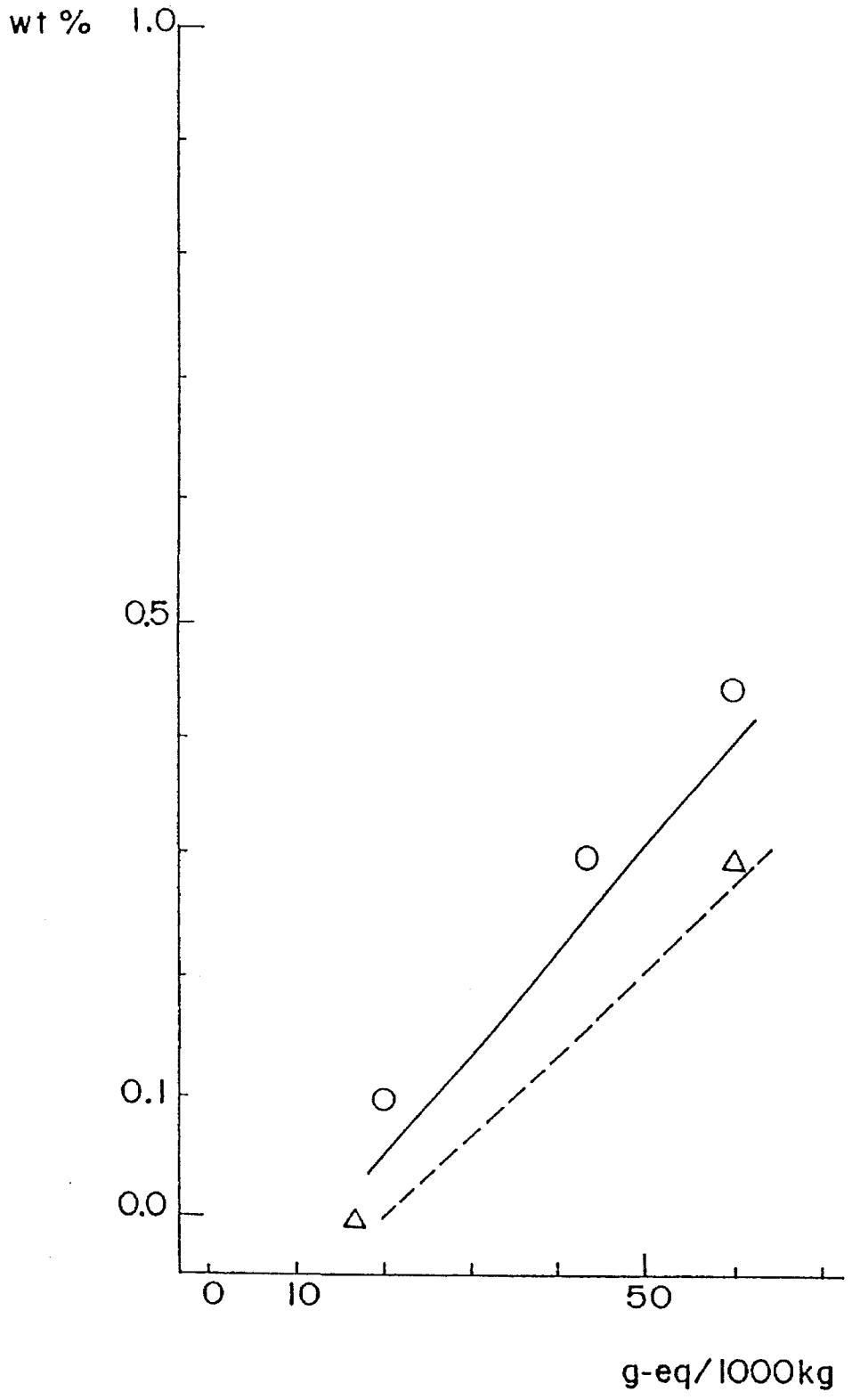
FIG. 1 shows the relationship of the amount (in % by weight) of the metal salt of a saturated fatty acid required for the increase of the degree of hollowness and the degree of non-circularity (modification ratio) with the amount (in gram equivalent/1,000 kg of polyamide) of a terminal carboxyl group in a polyamide.

Based on the finding (2) (Run No. 8 through 25), the graph shown in FIG. 1 is obtained which illustrates the relationship of the amount of magnesium stearate required for the increase of the degree of hollowness with the amount of the terminal carboxyl group. The ordinate and the abscissa indicate the amount of magnesium stearate (% by weight) and the amount of the terminal carboxyl group (gram equivalent/1,000 kg of polyamide), respectively. The solid line in FIG. 1 corresponds to the equation:

$$Y=0.00871X-0.13.$$

As seen from FIG. 1, the desired degree of hollowness is obtained with the amount of the metal salt wherein the value of Y is equal to or larger than that satisfying the above equation. The upper limit of the amount of the metal salt is not particularly limited, but is generally about 1.2% by weight.

Experiment 2

Among the polyamides shown in Table 1, polyamides B and D which gave a great difference in the degree of hollowness were used in this experiment. To each of polyamides B and D, magnesium stearate was added in an amount shown in Table 3 and the polyamide mixture was melt-spun. Namely. the polyamide mixture was melt-extruded through a spinneret plate having 10 Y-shaped orifices (as illustrated in FIG. 3A) with slots of a 0.055 mm width at a spinning temperature of 250° C. and a spinning speed of 800 m/min to obtain an undrawn filament yarn composed of 10 filaments and having 60 deniers.

The degree of non-circularity (modification ratio) as expressed by the ratio of diameter R of the circumscribed circle drawn in the cross-section of the fiber to diameter r of the inscribed circle drawn in the cross-section thereof (FIG. 3B) is shown in Table 3.

TABLE 3

| Run No. | Polyamide | Amount of Mg-St. (wt. %) | Modification Ratio |
|---|---|---|---|
| 26 | B | — | 1.3 |
| 27 | B | 0.5 | 1.3 |
| 28 | B | 1.0 | 1.4 |
| 29 | B | 1.5 | 1.5 |
| 30 | B | 2.0 | 1.5 |
| 31 | D | — | 1.5 |
| 32 | D | 0.5 | 1.8 |
| 33 | D | 1.0 | 1.9 |
| 34 | D | 1.5 | 2.2 |
| 35 | D | 2.0 | 2.4 |

The relationship of the amount of magnesium stearate required for the increase of the degree of non-circularity (modification ratio) with the amount of the terminal carboxyl group is shown by a broken line in FIG. 1. The broken line in FIG. 1 corresponds to the following equation:

$$Y=0.0075X-0.15$$

wherein X and Y are as defined above. As seen from FIG. 1, the degree of non-circularity (modification ratio) greatly varies depending upon the amount of magnesium stearate.

The present invention is based on the findings that, when a metal salt of a saturated fatty acid is added to a polyamide, the flow rate in volume (which is a typical example of an external lubrication effect) varies at the melt-spinning step, and this change of the flow rate is prominent if the content of the terminal carboxyl group in the polyamide is small. In contrast, when a metal salt of a saturated fatty acid is added to a polyamide, the melt viscosity of a polyamide (which is a typical example of an internal lubrication effect) is reduced, and this reduction of melt viscosity is prominent if the content of the terminal carboxyl group is large. Thus, the balance between the external lubrication effect and the internal lubrication effect varies depending upon the particular amount of the terminal group.

More specifically, the state of dispersion of the metal salt in a polyamide varies depending upon the particular amount of the terminal carboxyl group in the polyamide. In a polyamide having a small amount of a carboxyl terminal group, the metal salt is distributed on the interface of the polyamide, and it is presumed that the metal salt envelops the polymer molecule at the melt-extrusion step and the apparent surface tension is increased with the result of an improvement of the degree of hollowness and/or the degree of non-circularity (modification ratio). The state of dispersion of the metal salt varies depending upon the compatibility of the polymer with the metal salt. In other words, the external lubricating effect varies depending upon the amount and proportion of the terminal group, and when the amount of the terminal carboxyl group is small, the carboxyl group is apt to be located on the interface between the polymer and the metal salt. This is because the metal salt is liable to be coordinated with the terminal carboxyl group.

Thus, in the present invention, the degree of hollowness and/or the degree of non-circularity (modification ratio) are enhanced by controlling the surface tension of a polyamide based on the chemical structure characteristics of the terminal groups of the polyamide and the metal salt.

The polyamide hollow and/or non-circular fiber of the present invention is useful for construction of floor coverings such as a carpet, and for fabrics having attractive appearance.

What is claimed is:

1. A polyamide hollow and/or non-circular fiber comprising a metal salt of a saturated fatty acid having at least 10 carbon atoms, wherein the amount (X) of a terminal carboxyl group of the polyamide constituting the fiber is not larger than 60 gram equivalent per 1,000 kg of the polyamide and the amount (Y) (in parts by weight per 100 parts by weight of the polyamide) of the metal salt of a saturated fatty acid satisfies the following formula:

$$Y \geqq 0.00871X - 0.13$$

wherein X is the amount of the terminal carboxyl group in gram equivalent/1,000 kg of the polyamide, and the ratio of the amount of a terminal amino group to the amount of a terminal carboxyl group in the polyamide is at least 3.

2. A polyamide hollow and/or non-circular fiber as claimed in claim 1, wherein the metal salt of a saturated fatty acid having at least 10 carbon atoms is magnesium stearate.

3. A polyamide hollow and/or non-circular fiber as claimed in claim 1, wherein the polyamide is polycaproamide.

* * * * *